US009550099B2

(12) United States Patent
Lignelli et al.

(10) Patent No.: US 9,550,099 B2
(45) **Date of Patent: *Jan. 24, 2017**

(54) HANDLE-DAMPENING LACROSSE STICK

(71) Applicant: Wm. T. Burnett IP, LLC, Baltimore, MD (US)

(72) Inventors: Joanna Lignelli, Baltimore, MD (US); Anthony Abdelmalek, Baltimore, MD (US); Mike Schmittdiel, Baltimore, MD (US)

(73) Assignee: WM. T. BURNETT IP, LLC, Baltimore, MD (US)

( * ) Notice: Subject to any disclaimer, the term of this patent is extended or adjusted under 35 U.S.C. 154(b) by 581 days.

This patent is subject to a terminal disclaimer.

(21) Appl. No.: 13/873,920

(22) Filed: Apr. 30, 2013

(65) Prior Publication Data

US 2013/0244816 A1 Sep. 19, 2013

Related U.S. Application Data

(63) Continuation-in-part of application No. 13/267,537, filed on Oct. 6, 2011, now Pat. No. 8,727,915.

(60) Provisional application No. 61/640,358, filed on Apr. 30, 2012.

(51) Int. Cl.
*A63B 59/02* (2006.01)
*A63B 65/12* (2006.01)

(52) U.S. Cl.
CPC ..... *A63B 59/02* (2013.01); *A63B 59/20* (2015.10); *A63B 60/06* (2015.10); *A63B 60/08* (2015.10); *A63B 60/10* (2015.10); *A63B 60/54* (2015.10); *A63B 60/26* (2015.10); *A63B 60/50* (2015.10)

(58) Field of Classification Search
CPC ..... A63B 59/02; A63B 65/12
USPC ..... 473/505, 512, 513
See application file for complete search history.

(56) References Cited

U.S. PATENT DOCUMENTS

| | | | | | |
|---|---|---|---|---|---|
| 1,013,438 | A | * | 1/1912 | Post | 279/50 |
| 2,710,753 | A | * | 6/1955 | Lockwood | 473/513 |
| 3,507,495 | A | | 4/1970 | Tucker et al. | |
| 4,034,984 | A | | 7/1977 | Crawford et al. | |
| 4,367,871 | A | * | 1/1983 | Schiefer | 473/463 |
| 4,609,198 | A | * | 9/1986 | Tarr | 473/523 |
| 5,071,125 | A | * | 12/1991 | Shen | 473/521 |
| 5,566,947 | A | | 10/1996 | Tucker et al. | |
| 5,651,744 | A | * | 7/1997 | Millon et al. | 473/513 |
| 5,902,656 | A | * | 5/1999 | Hwang | 428/36.91 |

(Continued)

*Primary Examiner* — Gene Kim
*Assistant Examiner* — M Chambers
(74) *Attorney, Agent, or Firm* — Ober, Kaler, Grimes & Shriver; Royal W. Craig

(57) ABSTRACT

A lacrosse stick for reducing the rebound of a ball caught therein. The head of the lacrosse stick has a socket for receiving the shaft, and incorporates one or a plurality of flexible elastomer pads within or as part of the handle or socket, where the head and handle meet, to damp impact and rebound. The flexibility of the damping pads produces a "give" that minimizes the rebound of a pocket after being impacted by a ball. This pocket dampening limits the movement of the ball and makes the ball easier to control and to retain in the pocket. The precise location of the dampening material on the lacrosse head may be varied to control the degree of pocket "give" in response to, for example, the force on the pocket created by a ball impacting the pocket during a catch or swinging in the pocket during cradling.

28 Claims, 10 Drawing Sheets

(56) References Cited

U.S. PATENT DOCUMENTS

| | | | | |
|---|---|---|---|---|
| 7,108,616 | B2 * | 9/2006 | Morrow et al. | 473/513 |
| 7,282,000 | B2 * | 10/2007 | Brine et al. | 473/513 |
| 8,727,915 | B2 * | 5/2014 | Lignelli et al. | 473/513 |
| 2005/0282666 | A1 * | 12/2005 | Morrow | 473/513 |
| 2009/0264227 | A1 * | 10/2009 | Price et al. | 473/513 |
| 2012/0264551 | A1 * | 10/2012 | Lignelli et al. | 473/513 |
| 2013/0244816 | A1 * | 9/2013 | Lignelli et al. | 473/513 |

* cited by examiner

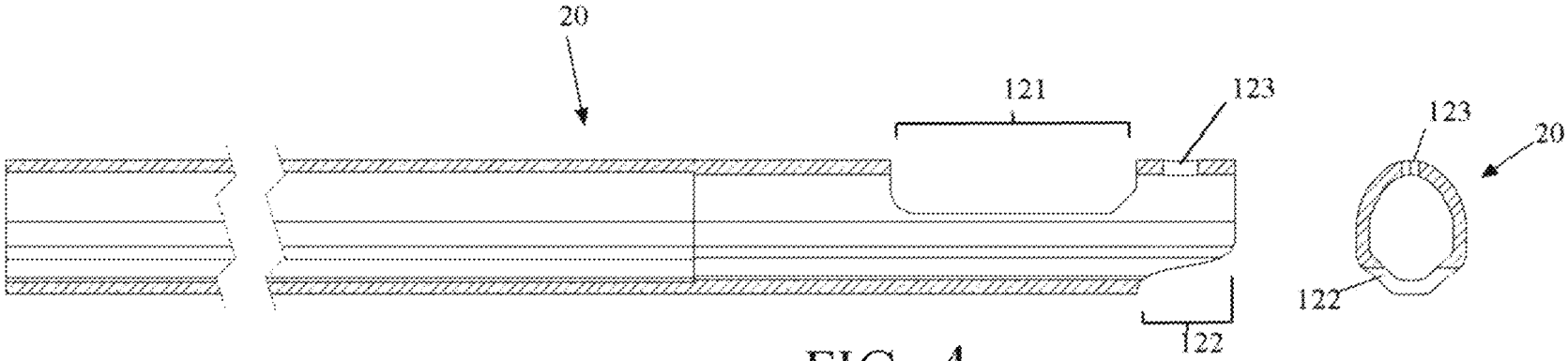
FIG. 4
FIG. 6
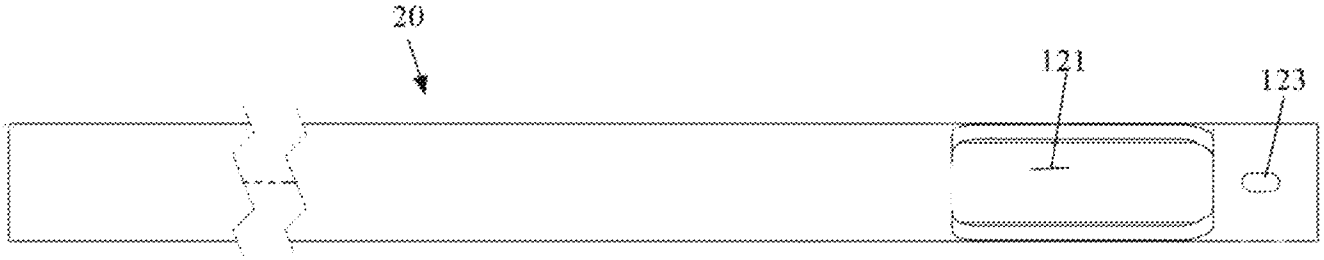
FIG. 5

HANDLE-DAMPENING LACROSSE STICK

CROSS-REFERENCE TO RELATED APPLICATIONS

The present application claims priority to U.S. Provisional Patent Application Ser. No. 61/640,358 filed 30 Apr. 2012, and is a continuation-in-part of U.S. application Ser. No. 13/267,537, which derives priority from U.S. Provisional Application 61/390,339 filed Oct. 6, 2010.

BACKGROUND OF THE INVENTION

1. Field of the Invention

The present invention relates generally to lacrosse sticks, and more particularly to an apparatus and method for dampening the rebound of a lacrosse stick head pocket after the pocket has had force applied to it by, for example, a caught lacrosse ball.

2. Description of the Background

FIG. 1 illustrates a conventional molded-head lacrosse stick. As shown, a typical lacrosse stick includes a handle or shaft (dashed lines) and a double-wall synthetic head 10. Head 10 includes a generally V-shaped frame having two sidewalls 14A, 14B joined by a socket 11 at the narrow end of the "V" for receiving and seating the shaft. A transverse wall (or "scoop") 16 joins the sidewalls 14A, 14B at the open end of the "V." Webbing is woven between the sidewalls 14A, 14B, scoop 16 and stop member 18 to form a pocket. The "double-wall" descriptor applied to the head 10 refers to the fact that it has two sidewalls as opposed to the single sidewall found in traditional wooden lacrosse sticks in which the pocket is completed by a woven gut wall in place of a second, solid sidewall. The shaft joins the narrow end of the head 10 and is received in socket 11, which includes a stop member 18 defined by a closed-ended socket, and an outer throat 12 supported by extensions of the sidewalls. The throat 12 and stop member 18 are integrally joined to form one unitary socket 11. A screw or other fastener 22 placed through socket 11 secures the head 10 to the shaft. The modern double-wall head 10 is a monolithic structure that is injection-molded from synthetic materials such as nylon, urethane and polycarbonate as known in the art.

The head 10 of the lacrosse stick may be strung in one of several ways with a series of strings and/or mesh to form a pocket for catching and throwing the lacrosse ball. Traditionally-strung pockets are required by the rules of the women's game and have four or five longitudinal leather and/or synthetic thongs, eight to twelve stitches of lateral cross-lacing and no more than two "shooting/throw" strings. To facilitate stringing of the thongs, a series of upper thong holes 32 are provided in transverse wall 16 and paired with corresponding thong holes 34 in stop member 18. To complete the pocket web, nylon strings are woven around the thongs and laced through string holes 36 in sidewalls 14A, 14B and one or more throwing or shooting strings are woven through the thongs extending transversely between the throwing string holes 38 on the upper portions of sidewalls 14A, 14B. These are typical features of a lacrosse stick and are shown generally in Tucker et al., U.S. Pat. No. 3,507,495; Crawford et al., U.S. Pat. No. 4,034,984; and Tucker et al., U.S. Pat. No. 5,566,947, which are each incorporated herein by reference. In order to comply with the rules of the women's game, the pocket must be strung such that the top of a lacrosse ball (2.5 inches in diameter) placed in the pocket held horizontally extends above the top edge of the side walls 14A, 14B. The rules of the men's game allow traditional stringing but also permit mesh pockets that are significantly deeper and more forgiving. The pocket of a men's stick must be strung so that the top of a lacrosse ball placed in the pocket extends above the bottom edge of the side walls 14A, 14B.

Although the synthetic materials used in the construction of the head 10 impart many performance advantages over traditional wooden heads, the synthetic, monolithic double-wall head fails to outperform wooden heads in one critical aspect: pocket "give." Specifically, whereas traditional unitary single walled wooden and gut sticks deflected under the force of a caught ball, the strength and rigidity of synthetics required for head durability combined with a rigid metal or composite shaft precludes pocket "give", and more give is desirable to facilitate catching the bouncy, hard rubber lacrosse ball. Because the synthetic heads use substantially rigid materials to provide the structural integrity and durability of the head frame, the thong holes provide little deflection against which the pocket strings can pull or stretch. In other words, the thong holes in a synthetic head do not deaden the tension of the pocket webbing, as occurs, for example, when a lacrosse ball hits the pocket. Similarly, the rigid connection between the head 10 and the unyielding shaft provides no deadening or absorption of the force of the ball.

Notably, this pocket "give" is most critical in the women's game in which shallow pocket depth rules necessitate tightly strung pockets. As a result of the necessary tension, when a lacrosse ball hits the pocket the impact forces are returned to the ball, producing a rebounding or trampoline effect that can propel the ball out of the pocket. This makes it difficult to catch and control thrown balls, particularly balls thrown at high velocity. Indeed, for all but the most skilled players, a lacrosse ball can easily bounce out of a legally strung pocket. In essence, the pocket, strung on a rigid unforgiving frame, can acts like the strings of a tennis racquet to rebound the ball out of the pocket. Although this trampoline effect is more pronounced in the tightly strung women's lacrosse heads, the desire to absorb the impact of an incoming ball is equally applicable to men's lacrosse heads. Thus, there remains a need for an apparatus that provides the pocket "give" of a traditional wooden head while maintaining the lightness, durability, and structural integrity of modern synthetic lacrosse heads.

SUMMARY OF THE INVENTION

It is, therefore, an object of the present invention to provide a method and apparatus for dampening the rebound of a lacrosse head and pocket after the pocket has had force applied to it by, for example, a thrown lacrosse ball.

Unlike the substantially rigid lacrosse head frames of the prior art, which attach pocket thread to unforgiving, rigid structures, the present invention provides a flexible, energy-absorbing elastomer insert within a specially-formed handle that exposes the elastomer insert to the socket (throat and/or stop member) of the head, where the head and handle meet. The material within the handle and abutting the socket throat/stop member dampens the recoil of an otherwise rigid head and handle. The flexibility of the insert material produces a "give" that minimizes the rebound of a pocket after being impacted by a ball. This pocket dampening suppresses movement of the ball and makes the ball easier to control and to retain in the pocket, a basic fundamental of the game. The precise location of the dampening material on the lacrosse head may be varied to control the degree of pocket "give" in response to, for example, the force on the pocket created by a ball impacting the pocket during a catch or swinging in the pocket during quick, side to side rotations of the head, known as cradling, another basic fundamental of the game.

The present invention is generally constructed of one or more elastomeric insert(s) seated within the end of a shaft formed with a lower (fastener side) window which exposes the elastomeric insert to the inner wall of the throat 12 (see FIG. 1) and preferably an upper distal cutout to expose the elastomeric insert to the opposite inner wall of throat 12 and to stop member 18. The upper distal cutout is positioned well within throat 12, ensuring that the upper rigid inner wall of the end of throat 12 interacts with the rigid shaft when in the throwing position in the same manner as it does in the neutral position, resulting in no "give" when force (e.g. throwing motion) is applied to the head and handle (see, FIGS. 19, 24).

Alternate embodiments are herein described in which portions of the socket wall are replaced by one or more elastomeric wall sections, preferably a first portion on the back side of the throat and a second portion on the front side of the stop member, offset from the first portion inwardly toward the pocket. This may be accomplished by molding or cutting windows, cavities or receptacles, or otherwise omitting areas within the socket, and overmolding or insetting the resilient member(s) such that they fill the cavities made in the socket. The resilient member(s) are contoured to fill the areas of omitted socket so as to be flush with the inside surface of the socket. The throat is aligned with the socket such that the shaft passes through the throat when received in the socket. The shaft inserted into the socket firstly engages the resilient insert in the omitted portion on the back side of the socket at the throat, and optionally secondly engages the second resilient insert offset inwardly toward the pocket on the front side of the stop member. When a force is applied to the front side of the head by, for example, a ball entering the pocket, the head leverages about the socket and compresses the first resilient member against the underside of the shaft, while optionally simultaneously compressing the second resilient against the topside of the shaft. This affords a degree of freedom and allows the head to rotate backward about an axis perpendicular to the shaft and thereby dissipate some of the energy of the thrown ball rather than returning that energy to the ball.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 4 is a side cross-section of the modified shaft 20 for use with the embodiment of FIGS. 2-3.

FIG. 5 is a top view of the modified shaft 20 of FIGS. 4-6.

FIG. 6 is a longitudinal cross-section view of the modified shaft 20 of FIG. 4.

DETAILED DESCRIPTION OF THE PREFERRED EMBODIMENT

The present invention is an apparatus and method for dampening the rebound of a lacrosse head after force has been applied to it by, for example, a lacrosse ball entering and striking its pocket.

Figure 1:
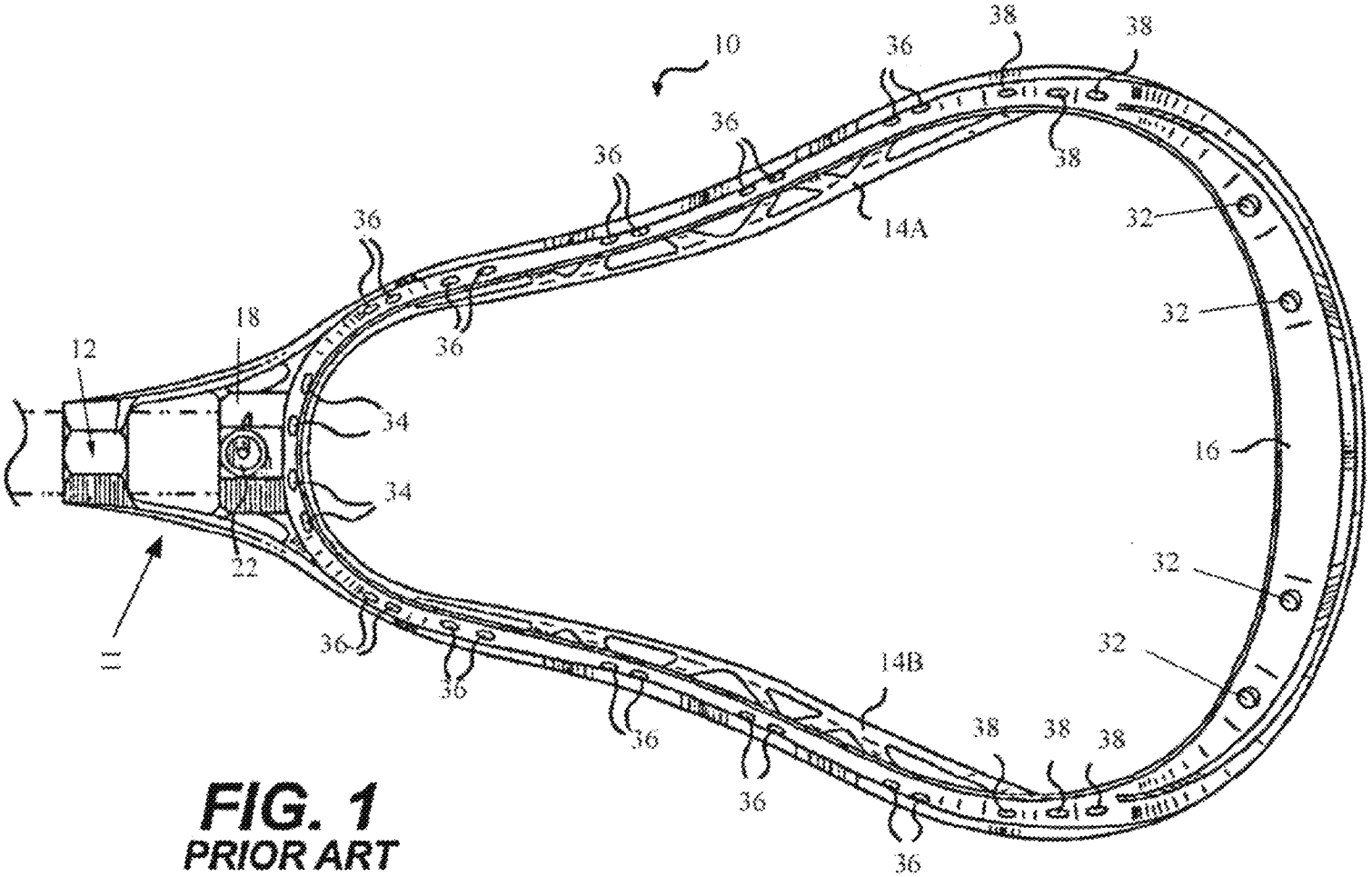
FIG. 1 PRIOR ART
FIG. 1 is a rear perspective view of a conventional (prior art) molded-head lacrosse stick.
Figure 2:
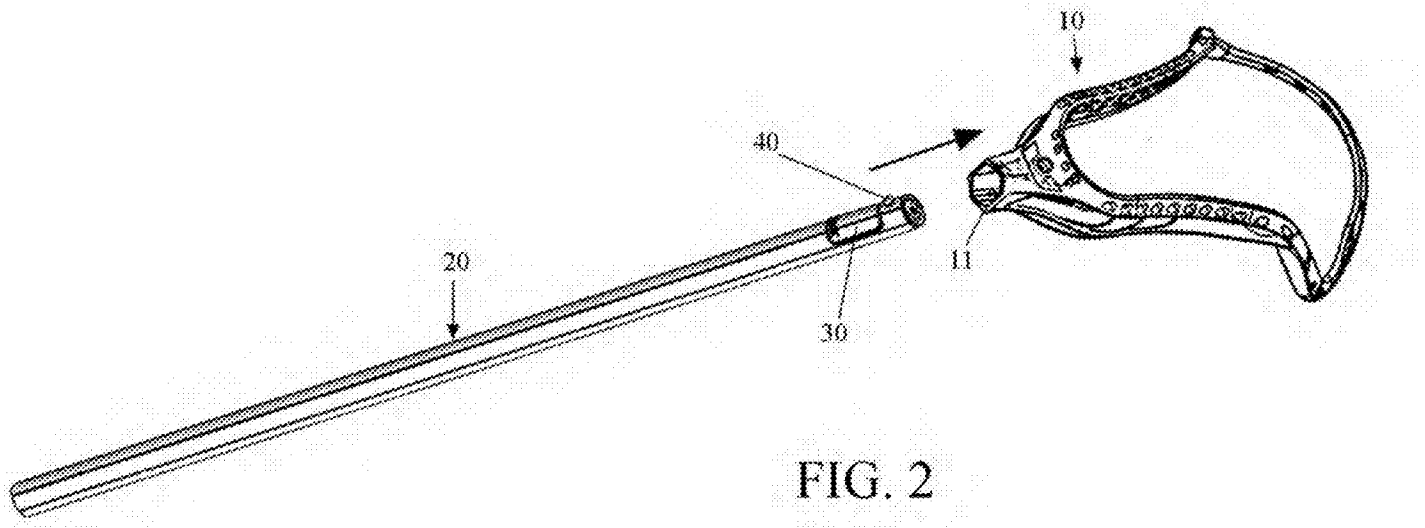
FIG. 2 is a rear exploded view of an exemplary embodiment of the invention designed for use with a conventional lacrosse head 10 as depicted in FIG. 1.
Figure 3:
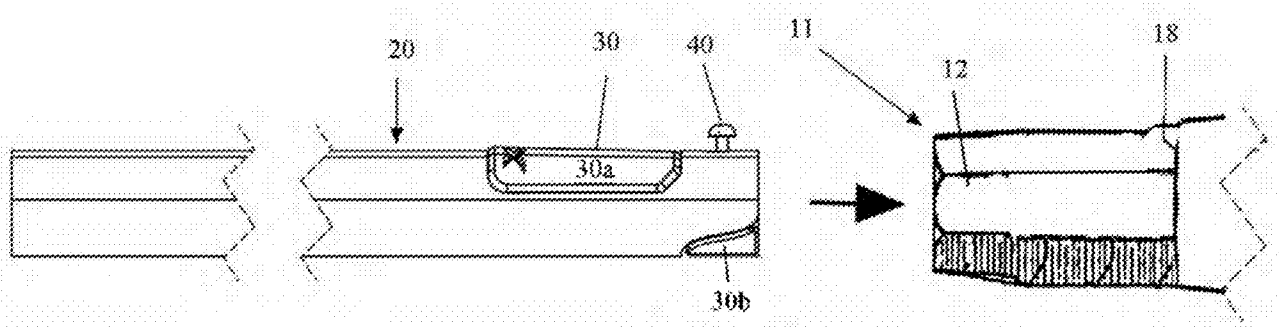
FIG. 3 is an enlarged partial side view of the embodiment of FIG. 2.

FIG. 2 is an exploded rear view and FIG. 3 is an enlarged side view of an exemplary embodiment of the invention designed for use with a conventional lacrosse head 10 such as, for example, depicted in FIG. 1. In this embodiment a lacrosse handle 20 is modified to accept a distal elastomeric insert 30. The handle 20 with insert 30 in place is then received within the socket 11 of the head 10 as described above. The socket 11 forms a collar about the shaft 20 with walls conforming to those of the shaft 20 (which is typically rounded hexagonal, octagonal, oval or circular cross section or any combination thereof) to secure the shaft within the socket and the head to the shaft. The shaft 20 is inserted into the socket 11 until the end of the shaft abuts the stop member 18 (see FIGS. 1, 3) and is there secured by one or more other suitable fasteners passing through both the wall of the socket 11 and the shaft 20. In the present embodiment, a specially-configured shoulder screw 40 is inserted through both the wall of the socket 11 and an aperture 123 (see, e.g., FIG. 5) in the shaft 20 before being secured to an anchor plate (described below) which is embedded in the insert 30. The aperture 123 is configured in a substantially elongate or oval shape to accommodate the intended movement and non-movement of the lacrosse head as described herein. In other words, the elongate shape enables deflection or movement of the screw in the direction parallel to the length of the shaft 20 when force is applied to the front of the head (e.g., as by catching a thrown ball in the pocket), but locks the screw against the rigid shaft wall to prevent movement when force is applied in the opposite direction (e.g., throwing motion). In addition, the elongate shape prevents the screw from loosening during play by moving in a direction perpendicular to the shaft. Again, the screw is locked out against and bounded by the rigid shaft wall in a direction perpendicular to the shaft.

It should be noted that relative terms such as for example "upper," "lower," or "top," "bottom," are used herein to describe the invention as depicted in the accompanying figures and are not intended to be limiting. Unless the context of the usage dictates otherwise, when used in reference to a lacrosse stick or head as a whole the term "front" refers to the side of the lacrosse stick in which a ball is caught and the term "back" refers to the side of the lacrosse stick opposite the "front." It should also be noted that the figures provided herein generally depict the illustrated lacrosse stick with the pocket side of the head (i.e., the front") facing downward. It will be apparent to skilled practitioners that the orientation of a lacrosse stick varies dramatically during play and the relative position of the elements of the present invention will similarly vary from those depicted.

With reference to FIG. 3, the shaft 20 is preferably a hollow, tubular member having walls configured to receive the elastomeric insert 30 and to expose one or more areas of the insert to the inner walls of socket 11 so as to achieve an elastic dampening effect in accordance with the invention. Specifically, the illustrated shaft 20 is formed with an inwardly-offset window that exposes a first portion 30*a* of the elastomer insert 30 to the socket 11 (see FIG. 3), plus a distal cutout that exposes a second portion 30*b* of the elastomer insert 30 (or second elastomeric insert) to socket 11 and to the inner stop member 18 of socket 11. Thus, with the shaft 20 fully inserted and seated, a lower forward portion 30*b* of the insert 30 engages the lower wall within socket 11, and an upper rearward portion of the insert 30*a* engages the upper wall of the socket 11 at throat 12. This way, when force is applied to the head 10 from a moving lacrosse ball, the head 10 pivots at the socket 11, and the exposed portions 30*a*, 30*b* of the insert 30 serve as cushioned bearing surfaces.

FIGS. 4-6 are a side cross-section, top, and end view, respectively, of a modified shaft 20 according to the present invention. A first portion 121 of the shaft wall is omitted to define the upper window and a second portion 122 on the lower distal end of the shaft is omitted to define a lower window. The first portion 121 is diametrically opposite and offset from the second portion 122 longitudinally away from the head 20. The elongate through-hole 123 is also provided through the shaft 20 in advance of the first portion 121 for passing a screw 40 or other fastening means. The first and second portions of removed material 121, 122 define opposing apertures about the central axis of the shaft 20 and are preferably situated on the back and front, respectively, of an assembled lacrosse stick. In the illustrated embodiment, the sidewalls of shaft 20 are generally hexagonal in cross-section, though any cross sectional shape (e.g., rounded hexagonal, octagonal, oval or circular) is possible. As seen in FIG. 4, the second omitted portion 122 of the shaft 20 wall essentially eliminates any lower wall on the front side of the shaft 20, leaving a U-shaped cutout at the lower front, ensuring that socket 11 of throat 12 extends well over removed portion 122 so that the interaction between shaft 20 and throat 12 is not affected by forces applied to throat 12 when head 10 moves in a direction required to propel a lacrosse ball from the pocket. As seen in FIG. 5, the first removed portion 121 opens a substantially rectangular window opposite the optionally second removed portion 122 and axially offset therefrom. The opening of removed portion 121 preferably spans the entire width of the shaft from side wall to side wall.

Figure 9:
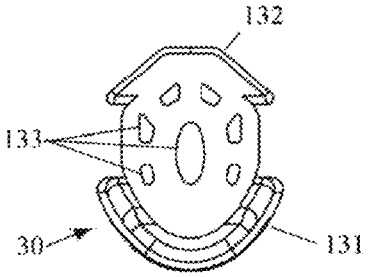
FIG. 9 is an end view of the elastomeric insert 30 of FIGS. 7-8.
Figure 11:
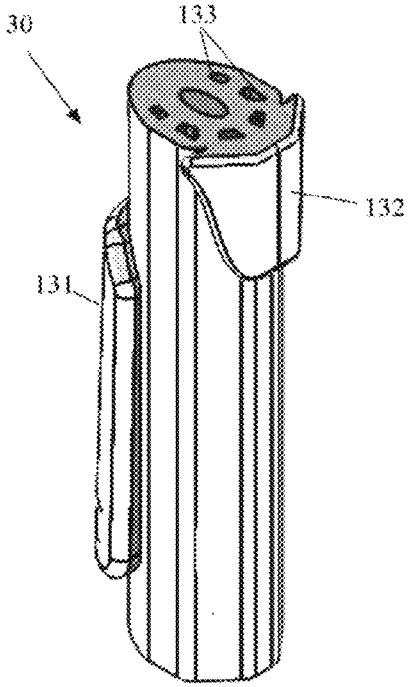
FIG. 11 is a perspective view of the elastomeric insert 30 of FIGS. 7-10.
Figure 7:
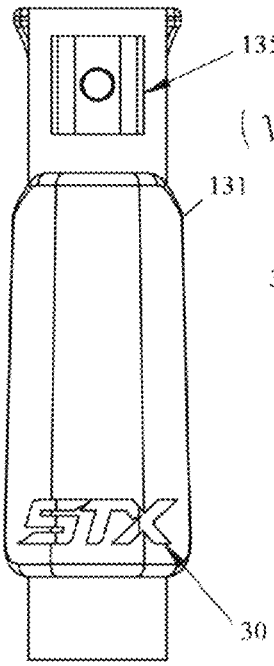
FIG. 7 is a top view of the elastomeric insert 30 for use with the embodiment of FIGS. 2-3.
Figure 8:
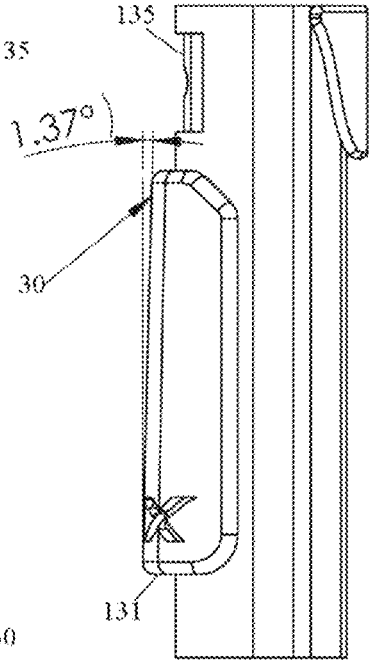
FIG. 8 is a side view of the elastomeric insert 30 of FIG. 7.
Figure 12:
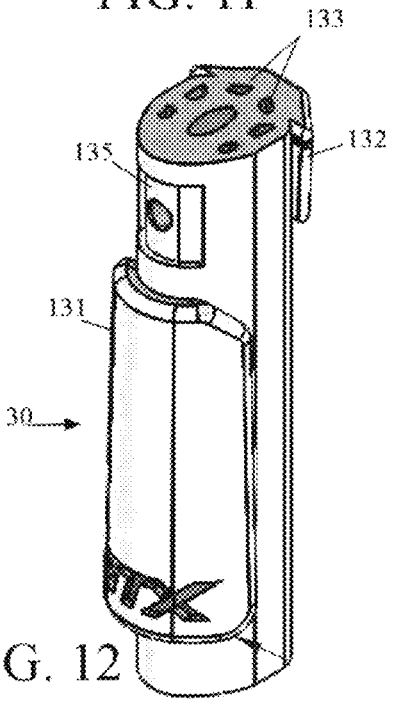
FIG. 12 is an opposing perspective view of the elastomeric insert 30 of FIG. 11.
Figure 10:
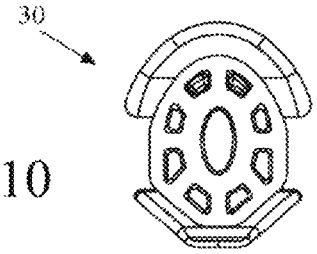
FIG. 10 is an opposing end view of the elastomeric insert 30 of FIG. 7-9.

FIGS. 7-12 are a top, side, opposing end, and opposing perspective views of the elastomeric insert 30, respectively. The insert 30 is preferably one or more unitary elastomeric members, more preferably a polyurethane elastomer (TPU), and most preferably a SEBS compound (Styrene-ethylene-butadiene-styrene). A durometer hardness of from 35-65 A is preferred. A suitable elastomer is commercially available from Shore, Inc.™ in their 55 A hardness SEBS compound. One skilled in the art will understand that other suitable thermoplastic polyurethane elastomers or other suitable elastomeric material may also be used. The insert 30 is preferably molded as an elongate member that substantially conforms to the interior confines of the shaft 20 (here substantially hexagonal). The insert 30 is provided with a first raised surface feature 131 conforming to the omitted first portion 121 of shaft 20 in order to bring insert 30 substantially flush with (or slightly proud of) the outer walls of shaft 20, and a second raised surface feature 132 that conforms to the omitted portion 122 of the shaft 20, likewise bringing insert 30 substantially flush with the outer walls of shaft 20 when seated therein. In the illustrated embodiment a rectangular recess 135 is formed in the elastomeric insert 30 proximate the first raised surface feature 131 in which to seat or embed (as by overmolding) an anchor plate as will be described. In this way the screw 40 may be anchored to the insert 30 by threading it into the anchor plate. As seen in FIG. 8, the top of the first raised surface feature 131 is formed with a slight top-to-bottom angle to ease endwise insertion of the shaft 20 and insert into the head 10 of the lacrosse stick, a suitable angle being between about 1.25 and 1.5 degrees as shown. As seen in FIG. 9, the insert 30 may be molded with lengthwise axially-spaced cavities, channels or grooves 133 which serve to reduce the stiffness of the insert 30 and also reduce its weight. In addition to material characteristics, these internal features 133 provide another means for controlling stiffness of insert 30.

Figure 13:
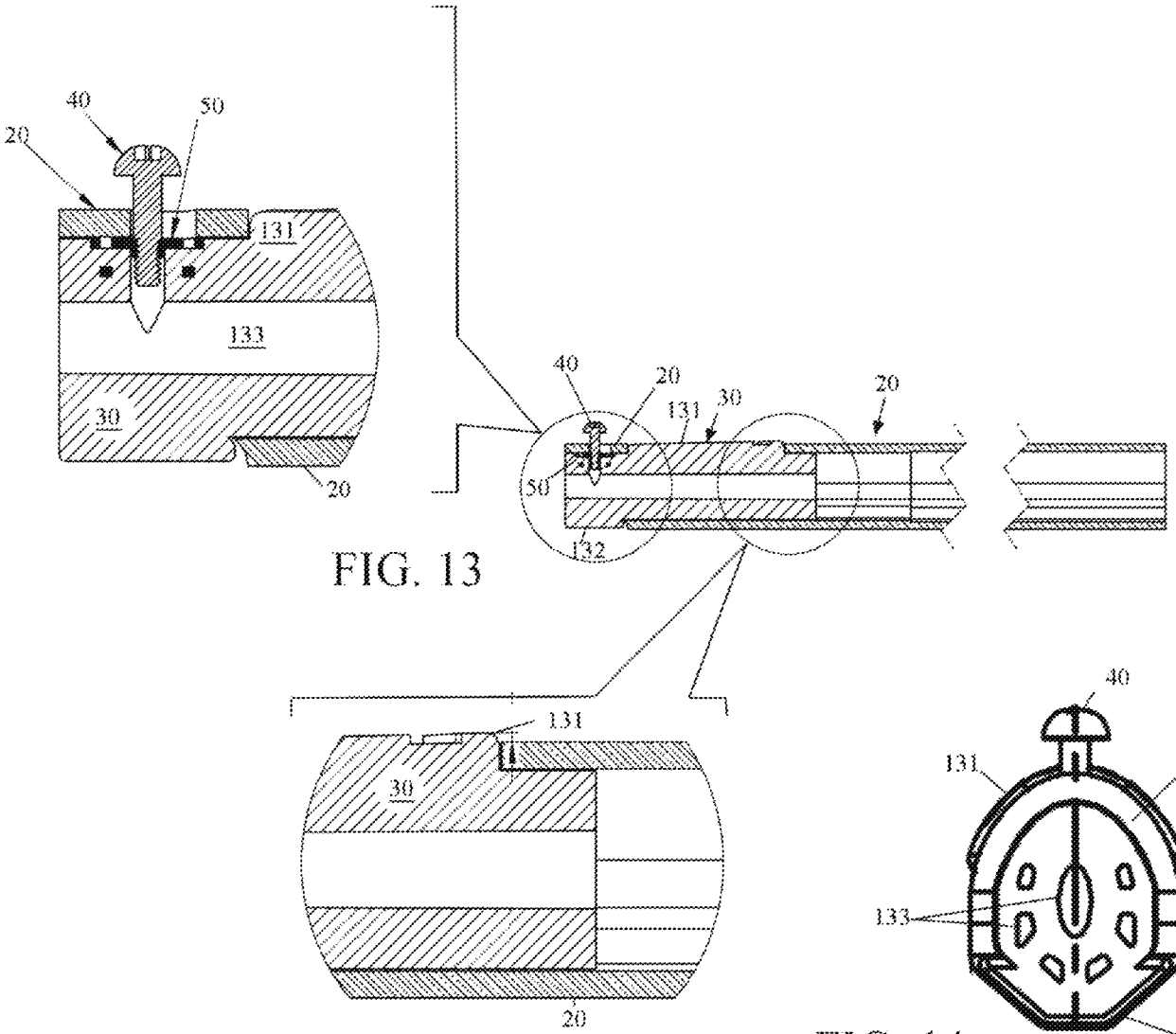
FIG. 13 is a composite cross-sectional view of the shaft and elastomeric insert of the embodiment of FIG. 2.
Figure 14:
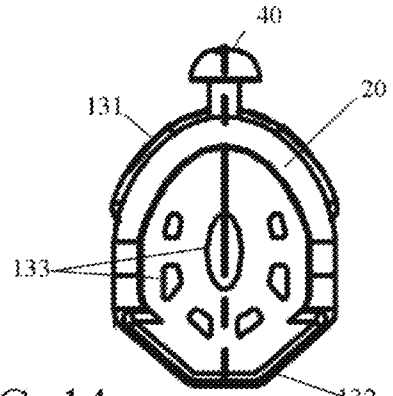
FIG. 14 is an end view illustrating the assembled insert 30 in shaft 20.

FIG. 13 is a composite cross-sectional view with inset enlargements detailing elements of the invention, and FIG. 14 is an end view, respectively, illustrating the assembled insert 30 in shaft 20 without the stick head 10 in place. The insert 30 is inserted endwise into shaft 20 as shown, the insert preferably containing the embedded anchor plate 50, the anchor plate having been inserted or overmolded into the recess 135. The insert 30 is fully inserted endwise into shaft 20 until the first raised surface feature 131 seats squarely within the first omitted portion 121 of shaft 20, at which point the second raised surface feature 132, if included, similarly slides into the second cutout portion 122 of shaft 20. At this point the surface features 131, 132 fully fill the voids 121, 122 in shaft 20 and the exposed areas of insert 30 become damping bearing surfaces against pivoting of the shaft 20. Preferably, the first raised surface feature 131 and window portion 121 extend within a range of from 1-3" along the central axis of shaft 20, and most preferably approximately 2". Preferably, the second raised surface feature 132 extends at least ⅛ inch (3.3 mm) along the central axis of shaft 20 at the edge, within an acceptable range of from about ⅛-1.5", and most preferably 1". The first raised surface feature 131/window portion 121 may be offset from the distal end of the shaft 20 by a distance equal to the length of the optional second raised surface feature 132. The second raised surface feature 132 operates like a compression zone and the first raised surface feature 131 like a second compression zone when a ball impacts the head 10.

Figure 15:
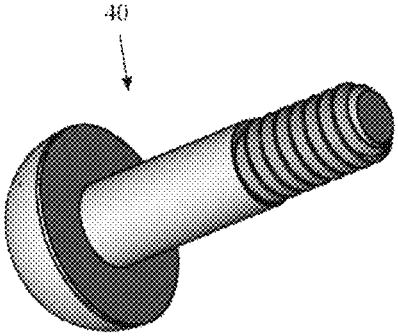
FIG. 15 is a perspective view of the shoulder screw of the embodiment of FIG. 2.
Figure 16:
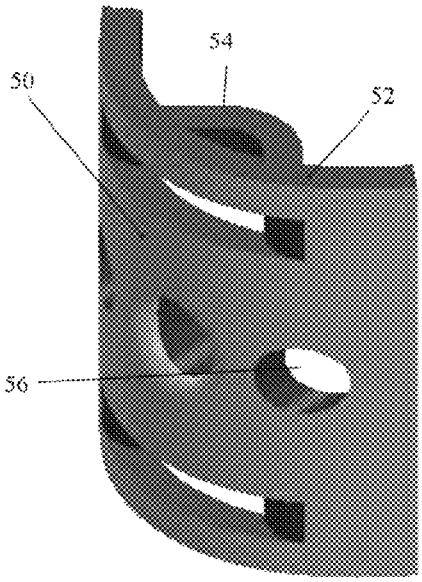
FIG. 16 is a perspective view of the anchor plate 50 of the embodiment of FIG. 2.
Figure 17:
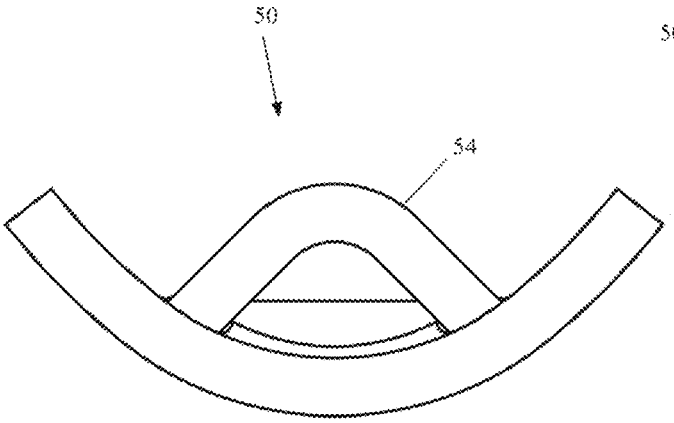
FIG. 17 is an end view of the anchor plate 50 of FIG. 16.
Figure 18:
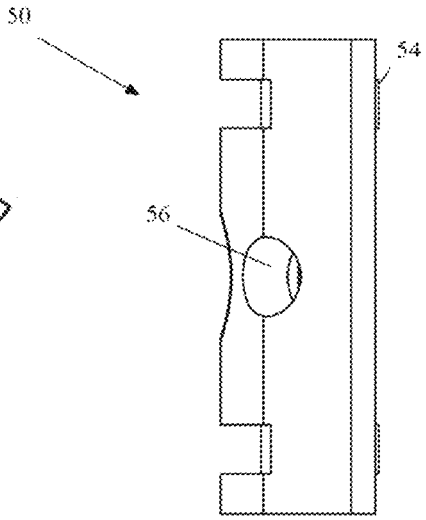
FIG. 18 is a side view of the anchor plate 50 of FIGS. 16-17.

FIG. 15 is a perspective view of the shoulder screw 40 of the present invention and FIGS. 16-18 are a perspective view, end view, and side view, respectively, of the anchor plate 50 which can be overmolded or otherwise inserted inside insert 30. Screw 40 is preferably a stainless or composite shoulder screw with machined screw threads, for example, 4-40 UNC 2A thread. Use of a "shoulder screw" (flat tipped) with machine threads as opposed to the standard metal screw allows for the screw 40 to bottom out on or in the anchor plate 50, thereby providing a positive stop and preventing over-tightening of the screw against the head 10. When fully inserted the shoulder screw 40 allows room for shifting, as noted above. A thread-lock compound is preferably used to prevent the screw 40 from backing out of the anchor plate 50 due to vibrations experienced by the screw (and entire stick) during play and particularly during stick to stick contact. Note that the shoulder portion of the screw extends through the round hole of the socket 11 of the head 10 and the elongate aperture 123 at the distal end of the aperture before being threaded into and tightened against the anchor plate 50. When fully tightened into the anchor plate 50 the screw head is held at the surface of the stick head 10 without compressing the stick head 10 against the shaft 20. In this way the stick head 10 is fixed longitudinally with respect to the shaft while being permitted to rotate with/at the screw 40 and against the compressions zones under force of a caught ball.

Anchor plate 50 may comprise an arched rectangular plate 52 preferably having two opposing rearwardly-punched elbows 54 and two side-by-side apertures 56, which features combine to provide a more secure four-point anchoring of plate 50 when embedded inside the overmolded elastomeric insert 30. Anchor plate 50 may be painted for better visibility during assembly.

Figure 19:
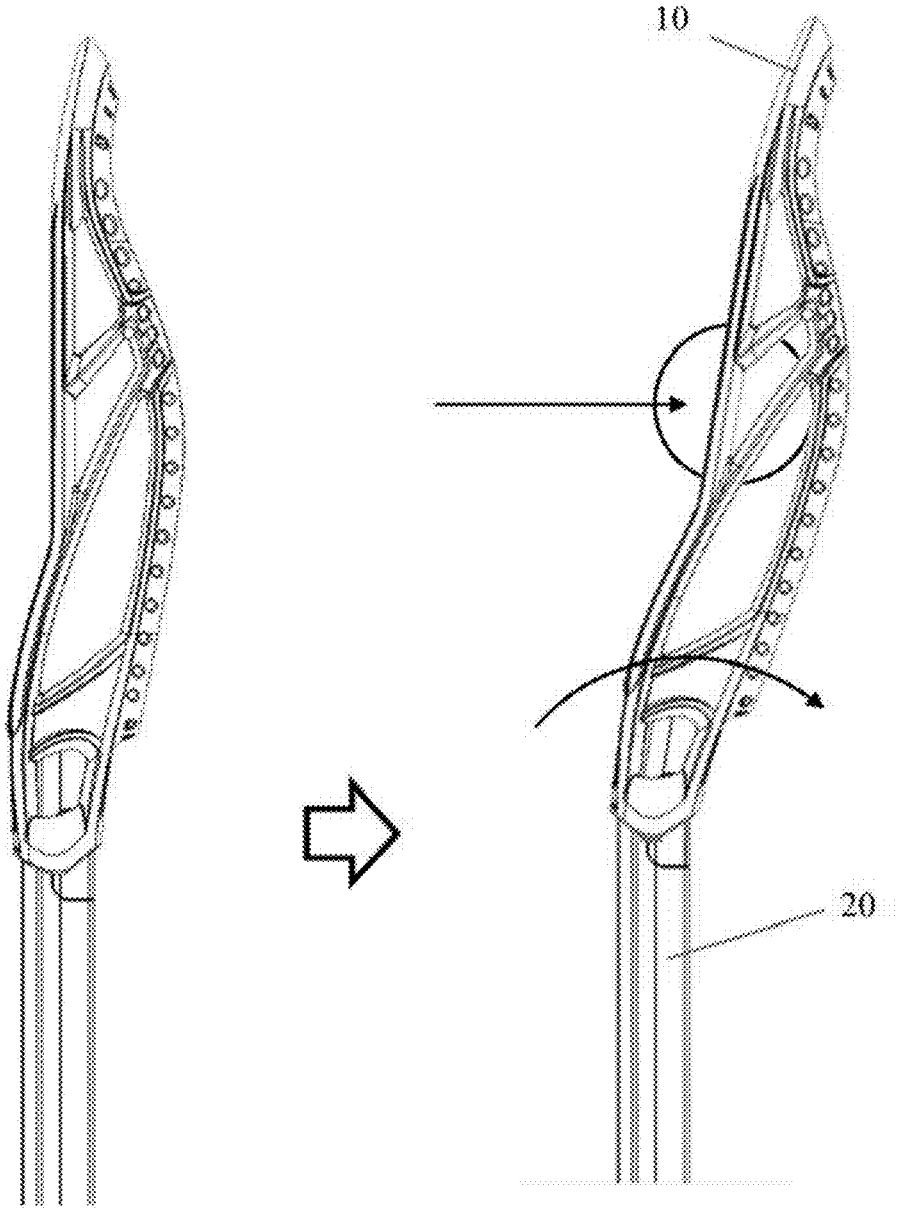
FIG. 19 is a side view operational diagram of the present invention.

In use, when force is applied to the head 10 such as from a thrown lacrosse ball received in the pocket from the front, the head 10 will pivot backwards. This rotation is depicted in FIG. 19. The inside socket 11 wall bears directly against the raised surface feature 131 of insert 30 (on the back of the stick, i.e., opposite the direction from which a thrown ball is received) to dampen and dissipate some of the energy of the moving ball. The raised surface feature 131 acts as a compression zone as the shaft 20 pivots within the socket 11. If utilized, head 10 also engages the second raised surface feature 132, adding further damping to prevent the ball from rebounding. The effect of the insert 30 is a softer, more forgiving catch of the thrown ball, damping the forces created by the ball entering and striking the pocket. One skilled in the art should understand that the hardness and physical construction of the insert 30 determines the amount of elasticity and thus resistance to rotation of the head 10. Unlike prior attempts in the art to create pocket "give" by altering the structure of the head 10 (see, for example, U.S. Pat. Nos. 6,916,259 and 7,131,919), the present invention utilizes the interaction of the head and handle and facilitates head 10 movement or flex in only one direction and does not facilitate head movement in the opposite direction. Such opposite direction head movement (e.g. in the throwing direction) would be undesirable to players since it contributes variability and inconsistency to passing and shooting which require considerable accuracy and consistency.

A similar effect may be attained using multiple inserts (essentially sub-dividing insert 30), and the multiple discrete insert elements may comprise different elastomeric materials having differing hardness or elasticity characteristics to tailor the feel of the stick. Multiple insert elements are considered to be within the scope and spirit of the invention.

Figure 20:
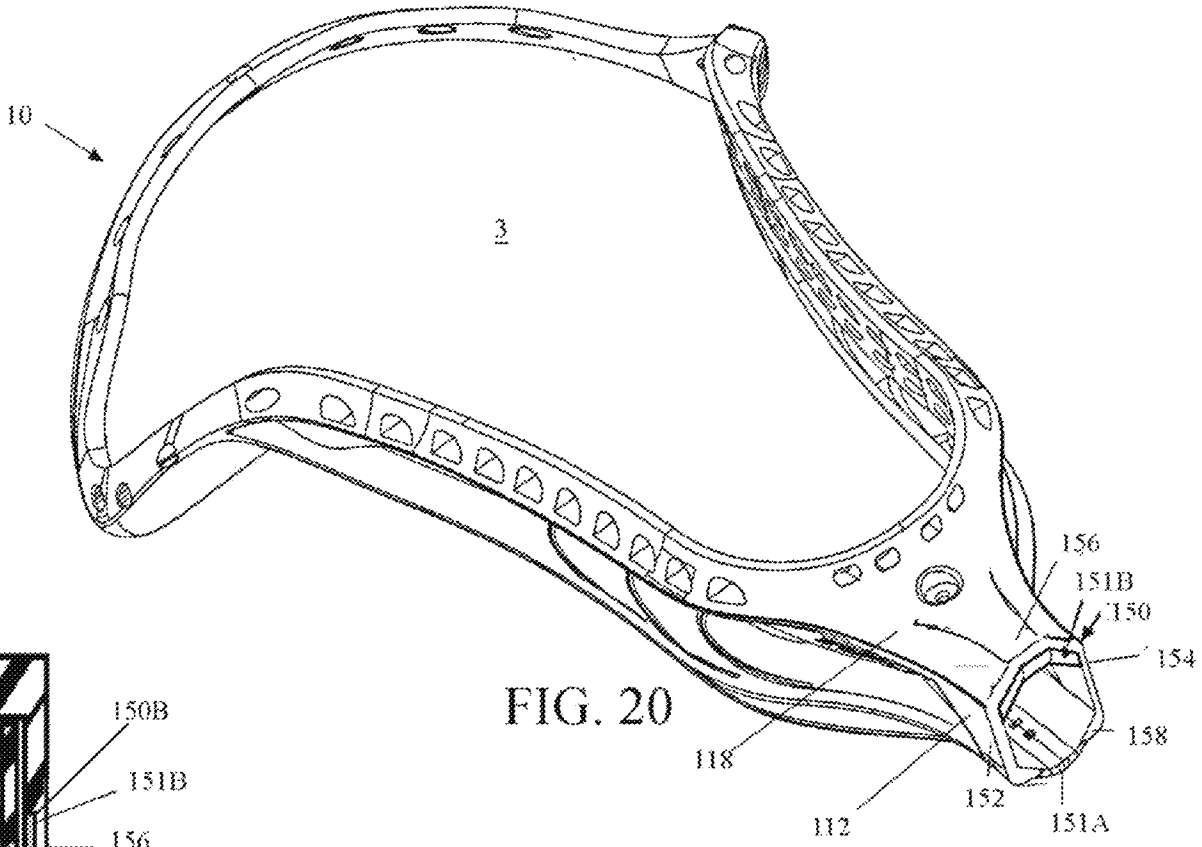
FIGS. 20-21 are a perspective view and side cross-section, respectively, of an alternate embodiment of the invention.
Figure 21:
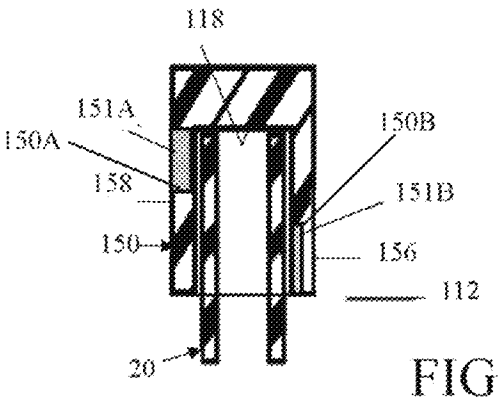

In alternate embodiments, rotation of the head 10 relative to the shaft 20 under force of a thrown ball can be achieved by elastomeric members incorporated into the walls of socket 11 rather than in shaft 20. FIG. 20 is a bottom perspective view and FIG. 21 is a side cross-section of an alternate embodiment of the invention, which generally includes a lacrosse head 10 defining a pocket 3 and adapted to receive a conventional (unmodified) hollow tubular lacrosse handle 20 or shaft inserted into a modified socket 150 of head 10. The socket 150 extends from a stop member 118 to a distal outer throat 112 and forms a collar about the shaft 20. The walls of the socket 150 generally conform to those of the shaft 20 (typically rounded hexagonal, octagonal, oval or circular cross section), although the walls of the socket 150 need not be solid. For purposes of reference, the walls of the socket generally have a bottom 156, a top 158 and opposing side walls 152, 154 (the head 10 being shown in an inverted position). The bottom and top walls 156, 158 of the socket 150 are configured to receive one or more resilient insert(s) 151B, 151A in order to achieve an elastic dampening effect in accordance with the invention similar to that described above. In the embodiment of FIGS. 20-21, a portion 150B of the bottom wall 156 of the socket 150 is omitted, as is a second portion 150A of the top wall 158 within the interior of the socket 150. The second portion 150A is offset forwardly/inwardly toward the pocket 3 relative to the first portion 150B.

With reference to FIG. 21, cross-sectionally, the first portion 150B of removed material is symmetrically positioned opposite the second portion 150A relative to a central axis of the socket 150 and includes a sufficient breadth to allow the shaft 20 clearance to pivot within the socket 150, even beyond the removed area upon maximum anticipated deflection of the head 10 under load of an entering lacrosse ball. In the illustrated embodiment, the side walls 152, 154 of socket 150 are substantially flat, parallel, and joined together at the top and bottom walls 156, 158, respectively. The first removed portion 150B of the socket 150 wall may or may not penetrate the top wall 156 of socket 150, and in the illustrated embodiment merely forms a recess along the inside surface of the socket 150 at the throat 112 of the socket 150. Alternately, the first removed portion 150B may penetrate, leaving the top wall 156 unbounded at the distal end. As can likewise be seen from FIG. 21, a second portion 150A on the bottom wall 158 of the socket 150 is optionally removed, offset from the first portion forwardly/inwardly toward the pocket 3 and proximate stop member 118. The second omitted portion 150A similarly may or may not penetrate the bottom wall 158 of the socket 150, but rather could merely form a recess along the inside surface of the socket 150 bottom wall 158 or alternatively a window. The breadth of the second portion 150A of removed material preferably spans from the side walls 152, 154 of the socket 150. In certain configurations consistent with the present invention the second portion 150A of removed material will overlap the first removed portion 150B longitudinally along the central axis of the socket 150.

With continued reference to FIG. 21, an insert 151A of resilient elastomeric material occupies the second portion of removed material 150A, essentially forming damping cushion at the bottom bounding wall 158 of socket 11. The side edges of the insert 151A may be welded, bonded, inserted, molded or otherwise affixed within the walls of socket 150.

An optional second insert 151B of resilient elastomer material occupies the first portion of removed material in the top wall 156 of socket 150 at the throat 112, forming a second damping pad therein. Both inserts 151A, 151B are more resilient than the hard-durometer material of the socket 150 walls, and may be formed of thermoplastic polyurethane elastomer (TPU) as described above or any other suitable elastomeric material. In certain embodiments the performance properties (i.e., hardness, elasticity, etc.) of the first and second inserts 151A, 151B may differ from one another. Both inserts 151A, 151B directly abut the surface of shaft 20 when the shaft is inserted into the socket 150.

The first insert 151A of resilient material follows the contour of the bottom wall 158 and spans the unbounded portion of the socket 150, extending from proximate the outermost extent at throat 112 to the innermost extent of socket 150 at stop member 118, but not quite filling the void of the first portion of removed material. Preferably, the first insert 151A extends at least ⅜ inch (10 mm) along the central axis of socket 150. The surface of the insert 151A is preferably raised or contoured as shown, and is affixed such that the outside surface of the insert 151A seats flush with the bottom wall 158 of the socket 150 to maintain a symmetrical aperture in the socket 150 for receiving the shaft 20 as seen in FIG. 21. The durometer hardness of the elastomeric material of the insert 151A can be selected from 20-95 A (ASTM D2240 type A durometer scale) to increase or decrease the relative amount of flexibility and "give" achieved by the overall assembly. A durometer hardness of from 35-50 A is preferred. The insert 151A may be of solid construction or may have on or more voids or perforations to control (increase) the degree of elasticity and head flex or "give," as well as to conserve the overall weight of the lacrosse stick. Again, the insert may also comprise multiple discrete elements of differing elastomeric materials having differing hardness or elasticity characteristics to tailor the feel of the stick The optional second insert 151B of resilient material conforms to the shape of the top wall 156 of socket 150 and seats within the recess formed by the second portion of removed material 150B in the top wall 156. The second insert 151B likewise spans top wall 156 of socket 150, extending from proximate the innermost extent of socket 150 at stop member 118 out along the shaft 20 to the outermost extent of socket 150 at throat 112, and again may partially or fully overlap the first insert 151A. Preferably, the second insert 151B extends at least ⅛ inch (3.3 mm) along the central axis of socket 150. The surface of the insert 151B is likewise contoured to conform to the shaft 20 and is affixed such that the outside surface of the insert 151B seats flush within the top wall 156 of socket 150 and maintains the symmetry of the aperture in socket 150 for receiving the shaft 20. The durometer hardness of the elastomeric material of the second insert 151B may likewise be selected from 20-95 A (ASTM D2240 type A durometer scale) to increase or decrease the relative amount of flexibility, but the second insert 151B serves merely as a dampening pad and need not "give" to the same extent of the first insert 151A. Thus, a durometer hardness of from 40-70 A is preferred. The insert 151B may likewise be of solid construction or may have on or more voids or perforations to control (increase) the degree of damping or "give", as well as to conserve the overall weight of the lacrosse stick. The insert 151B may also comprise multiple discrete elements of differing elastomeric materials having differing hardness or elasticity characteristics to tailor the feel of the stick.

Figure 24B:
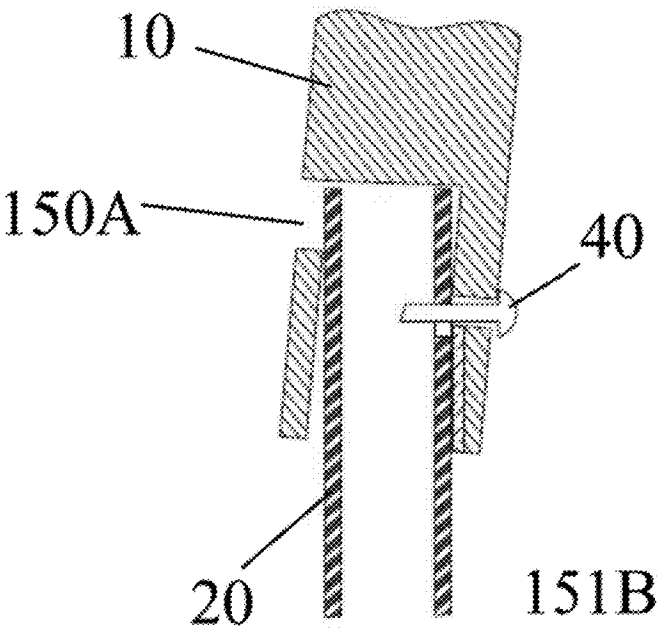
FIG. 24B is a partial section view of an embodiment of the invention under force of a caught ball.
Figure 24A:
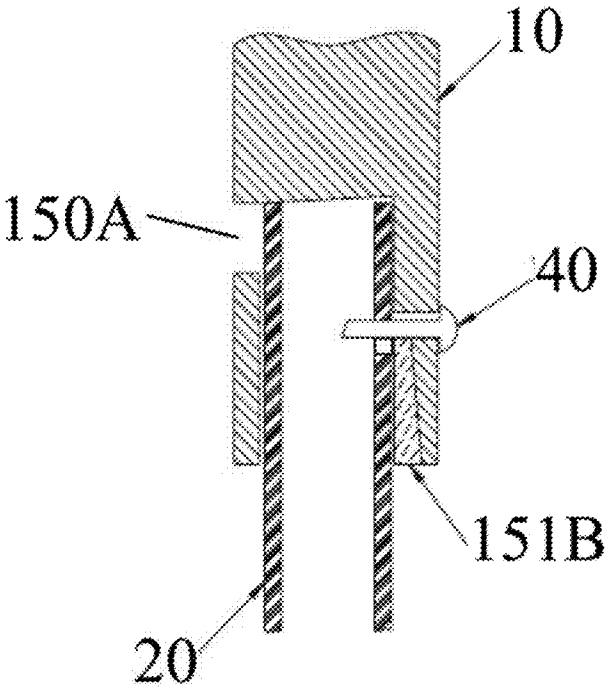
FIG. 24A is a partial section view of an embodiment of the invention in the neutral and throwing position.

With reference to FIGS. 24A, 24B, in use, when force is applied to the head 10 such as from a thrown lacrosse ball received within the pocket 3 from the front, the head 10 will pivot backwards and the inserts 151A, 151B operate similar to the embodiment of FIGS. 2-19. The effect of the first insert 151A, and to an even greater degree the cumulative effect of both inserts 151A, 151B allow for a softer, more forgiving catch of the thrown ball, damping the force even throughout the most severe impacts as seen in FIG. 19. Again, one skilled in the art will understand that the hardness and physical construction of the resilient inserts 151A, 151B determines the amount of elasticity and thus resistance to rotation of the head 10. As noted, a partial effect may be attained using either one of the inserts 151A, 151B, and a single insert is considered to be within the scope and spirit of the invention as indicated by FIG. 24.

Figure 22:
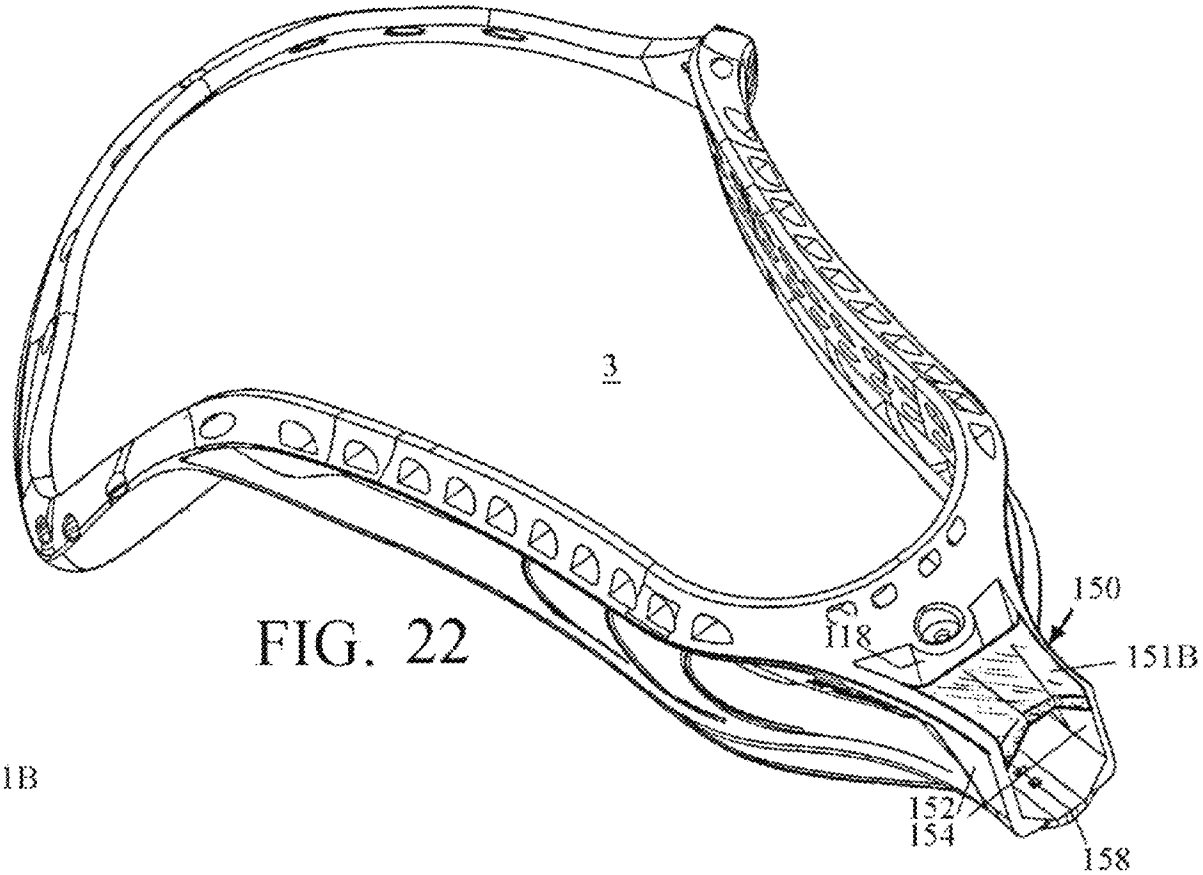
FIGS. 22-23 are a perspective view and side cross-section, respectively, of another alternate embodiment of the invention.
Figure 23:
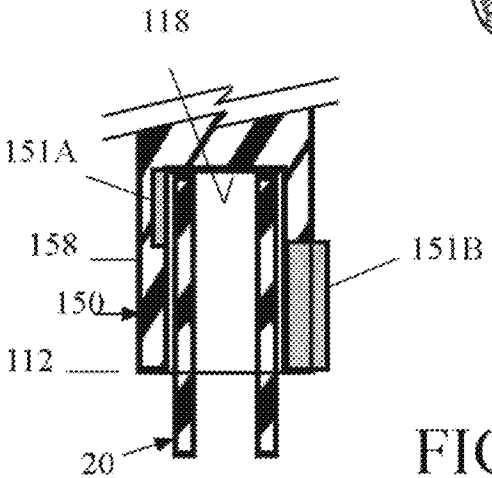

FIG. 22 is a back view of an alternate embodiment of the present invention, and FIG. 23 is a side cross-section of the embodiment of FIG. 22. The embodiment of FIGS. 22 and 23 is similar in effect to that of FIGS. 20 and 21, but inverts the configuration. The first removed portion of the socket wall virtually eliminates any top wall on the back side of the socket 11, leaving the side walls 152, 154 unbounded at the front. In one embodiment, the entire top wall 156 is replaced by insert 151B, and the second removed portion on the bottom wall 158 of the socket 150 is merely a recess with sufficient clearance to accommodate an insert 151A. The first insert 151B of resilient material essentially forms a lower bounding wall and may be welded, bonded, molded or otherwise affixed to the side walls 152, 154. The second insert 151A of resilient material occupies the clearance along the inside surface of the top wall 158, forming a damping pad therein. Again, both inserts 151A, 151B are more resilient than the walls of the socket 150, may be formed of suitable elastomeric material, and directly abut the shaft 20 when it is inserted into the socket 11. This embodiment is likewise dependent on the reaction of both the head and handle to the forces of an entering ball, rather than the head alone, and facilitates head movement or flex in only one direction, preserving the player's tactile feel of a lacrosse stick when the head and handle move in the opposite direction during passing and shooting.

It should now be apparent that the above-described method and apparatus effectively dampens the rebound of a lacrosse ball received in a head 10 pocket particularly one in which the webbing is strung taught according to the rules of the game. Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A lacrosse stick, comprising:

an elongate tubular shaft defined by walls surrounding an interior, and a discontinuity interrupting the walls of said shaft proximate one end;

a head having sidewalls surrounding a pocket, and a socket comprising opposing wall sections conforming to and receiving said shaft;

at least one elastomeric member contained inside said shaft and filling said discontinuity flush with said walls, and configured to make direct contact with the socket through said discontinuity when the one end of said shaft is received in said socket to provide a damped bearing surface there between.

2. The lacrosse stick according to claim 1, wherein said shaft further comprises a tubular wall defined by an aperture through said wall proximate to said socket, said at least one elastomeric member being seated in said shaft and protruding through said aperture.

3. The lacrosse stick according to claim 1, wherein said shaft further comprises a tubular wall defined by a distal cutout at one end, said at least one elastomeric member being seated in said shaft and protruding into said cutout.

4. The lacrosse stick according to claim 1, wherein said shaft further comprises a tubular wall defined by an aperture through said wall proximate to said socket, and a distal cutout at one end of said wall, said at least one elastomeric member being seated in said shaft and protruding through said aperture and into said cutout.

5. The lacrosse stick according to claim 1, wherein one of the opposing wall sections of said socket comprises said elastomeric member.

6. The lacrosse stick according to claim 1, wherein one of the opposing wall sections of said socket is defined by an internal recess within which said elastomeric member is seated.

7. The lacrosse stick according to claim 1, wherein one of the opposing wall sections of said socket is defined by an aperture within which said elastomeric member is seated.

8. The lacrosse stick according to claim 5, wherein said at least one elastomeric member comprises two elastomeric members each seated in one of the opposing wall sections of said socket.

9. The lacrosse stick according to claim 2, wherein said aperture comprises a generally rectangular window through said shaft offset from a distal end of said shaft.

10. The lacrosse stick according to claim 2, wherein said elastomeric member comprises a shaft insert having a raised surface feature for filling said aperture flush with said shaft.

11. The lacrosse stick according to claim 10, wherein said raised surface feature is angled relative to a center axis of said insert for ease of insertion into said socket.

12. The lacrosse stick according to claim 3, wherein said elastomeric insert comprises a shaft insert having a raised surface feature for filling said cutout flush with said shaft.

13. The lacrosse stick according to claim 10, wherein said elastomeric insert comprises an embedded anchor plate.

14. The lacrosse stick according to claim 13, further comprising a screw through said shaft and abutting said anchor plate.

15. The lacrosse stick according to claim 14, wherein said screw is a shoulder screw.

16. The lacrosse stick according to claim 13, wherein said anchor plate comprises an arched plate.

17. The lacrosse stick according to claim 16, wherein said anchor plate is overmolded into said elastomeric insert.

18. A lacrosse stick, comprising:

an elongate tubular handle having walls surrounding an interior, said walls comprising at least one discontinuity interrupting the walls of said shaft proximate one end;

a head having sidewalls surrounding a pocket, a scoop at one end, and a socket at an opposing end for receiving said handle;

an elastomeric insert inserted into the one end of said handle, said insert filling said discontinuity flush with said walls and in direct contact through said discontinuity to with the interior walls of said socket when the one end of said shaft is received in said socket, thereby providing a damping bearing surface there against.

19. The lacrosse stick according to claim 18, wherein the at least one discontinuity in the walls of said tubular handle further comprise two discontinuities including a first discontinuity defining an aperture through said handle offset inwardly from said end, and a second discontinuity defining a space at said one end.

20. The lacrosse stick according to claim 19, wherein the first discontinuity and second discontinuity are on opposing sides of said handle.

21. The lacrosse stick according to claim 18, wherein said at least one discontinuity comprises a cutout space into said end of said handle.

22. The lacrosse stick according to claim 18, wherein said at least one discontinuity comprises a substantially rectangular window through said handle offset from said one end.

23. The lacrosse stick according to claim 21, wherein said elastomeric insert comprises a raised surface feature for filling said cutout space into said end of said handle.

24. The lacrosse stick according to claim 22, wherein said elastomeric insert comprises a raised surface feature for filling said rectangular window through said handle.

25. The lacrosse stick according to claim 18, wherein said elastomeric insert comprises an embedded anchor plate.

26. The lacrosse stick according to claim 25, further comprising a shoulder screw through said handle and abutting said anchor plate.

27. The lacrosse stick according to claim 25, wherein said anchor plate is overmolded into said elastomeric insert.

28. A lacrosse stick, comprising:

a hollow tubular shaft having a top end for engagement with a head and an opening interrupting a wall of said shaft at the top end;

a head comprising a socket for receiving the top end of said shaft;

at least one resilient insert contained within the to end of said shaft and exposed through said opening in said shaft, and configured for direct contact with the socket of said head when the top end of said shaft is received in said socket for dampening a force applied to said head.

* * * * *